US006221199B1

(12) United States Patent
Chang et al.

(10) Patent No.: US 6,221,199 B1
(45) Date of Patent: Apr. 24, 2001

(54) APPARATUS AND METHOD FOR REMOVING AN ADHESIVE BONDED PAD

(75) Inventors: Yu-Chia Chang; Chih-I Peng, both of Hsin-Chu; Chen-Chia Chiu, Tainan; Yu-Sheng Shen, You-Hou, all of (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 0 days.

(21) Appl. No.: 09/243,033

(22) Filed: Feb. 3, 1999

(51) Int. Cl.[7] ..... B32B 35/00
(52) U.S. Cl. ..... 156/344; 156/584
(58) Field of Search ..... 156/344, 584; 29/426.1, 426.5, 239; 254/200, 203, 210, 211

(56) References Cited

U.S. PATENT DOCUMENTS 1,186,729 * 6/1916 Baker ..... 242/546.1
2,655,976 * 10/1953 Lovin ..... 156/584
3,830,441 * 8/1974 McQuiston ..... 254/222
5,387,308 * 2/1995 Heavrin ..... 156/584
5,454,899 * 10/1995 Glenn et al. ..... 156/584
5,551,136 * 9/1996 Bartlett ..... 19/239
5,891,297 * 4/1999 Stadtmueller ..... 156/344
6,004,426 * 12/1999 Johnson ..... 156/344

FOREIGN PATENT DOCUMENTS

3002831 * 7/1981 (DE) ..... 156/584

* cited by examiner

*Primary Examiner*—Mark A. Osele
(74) *Attorney, Agent, or Firm*—Tung & Associates

(57) ABSTRACT

An apparatus and a method for removing an adhesive bonded pad from a backing plate are disclosed. The apparatus and the method are particularly suitable for removing a polishing pad in a chemical mechanical polishing apparatus, however, they can be used for removal of any other adhesively bonded pad on a rigid surface. The removal apparatus can be advantageously used without causing any danger to a machine operator even when a slippage of the tool has occurred. The T-shaped removal tool can be operated in a rotational motion such that an adhesive bond existed between a pad and a backing surface may be broken by shear force. A minimal amount of force is required due to the large T-shaped handle used for the removal operation.

18 Claims, 2 Drawing Sheets

APPARATUS AND METHOD FOR REMOVING AN ADHESIVE BONDED PAD

FIELD OF THE INVENTION

The present invention generally relates to an apparatus and method for removing an adhesive bonded pad from a backing plate and more particularly, relates to an apparatus and a method for removing an adhesive bonded polishing pad from a backing plate in a chemical mechanical polishing apparatus by utilizing a T-shaped bar for removing the pad by shear force and rotational motion.

BACKGROUND OF THE INVENTION

Apparatus for polishing thin, flat semi-conductor wafers is well-known in the art. Such apparatus normally includes a polishing head which carries a membrane for engaging and forcing a semi-conductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semi-conductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 10 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel. Polishing heads of the type described above used in the CMP process are shown in U.S. Pat. No. 4,141,180 to Gill, Jr., et al.; U.S. Pat. No. 5,205,082 to Shendon et al; and, U.S. Pat. No. 5,643,061 to Jackson, et al. It is known in the art that uniformity in wafer polishing is a function of pressure, velocity and the concentration of chemicals. Edge exclusion is caused, in part, by non-uniform pressure on a wafer. The problem is reduced somewhat through the use of a retaining ring which engages the polishing pad, as shown in the Shendon et al patent.

Referring now to FIG. 1C, wherein an improved CMP head, sometimes referred to as a Titan head which differs from conventional CMP heads in two major respects is shown. First, the Titan head employs a compliant wafer carrier and second, it utilizes a mechanical linkage (not shown) to constrain tilting of the head, thereby maintaining planarity relative to a polishing pad 12, which in turn allows the head to achieve more uniform flatness of the wafer during polishing. The wafer 10 has one entire face thereof engaged by a flexible membrane 16, which biases the opposite face of the wafer 10 into face-to-face engagement with the polishing pad 12. The polishing head and/or pad 12 are moved relative to each other, in a motion to effect polishing of the wafer 10. The polishing head includes an outer retaining ring 14 surrounding the membrane 16, which also engages the polishing pad 12 and functions to hold the head in a steady, desired position during the polishing process. As shown in Figure IC, both the retaining ring 14 and the membrane 16 are urged downwardly toward the polishing pad 12 by a linear force indicated by the numeral 18 which is effected through a pneumatic system.

The polishing pad 12 is a consumable item used in a semiconductor wafer fabrication process. For instance, under normal wafer fab conditions, the polishing pad must be replaced aft er a usage of between 12 and 18 hours. The removal of a polishing pad from a table is therefore an important task in the operation of a CMP process. Since the pad is normally mounted to the rotating table by adhesive means, the removal of the polishing pad for replacement presents great difficulties. Conventionally, to remove a polishing pad from a table, a pair of pliers is first used to pry loose the edge of the pad from the table. The edge of the pad is then clamped by the pair of pliers and pulled manually by a machine operator. Since the adhesive bond is very strong, manual removal by using a pair of pliers is cumbersome and frequently causes personal injury to a machine operator when the pliers slips from the polishing pad.

It is therefore an object of the present invention to provide a method for removing an adhesive bonded pad from a backing plate that does not have the drawbacks or shortcomings of the conventional methods.

It is another object of the present invention to provide a method for removing an adhesive bonded pad from a backing plate that can be practiced without causing safety problems to a machine operator.

It is a further object of the present invention to provide a method for removing an adhesive bonded pad from a backing plate by utilizing a specially designed tool of a T-shaped removal bar.

It is another further object of the present invention to provide a method for removing an adhesive bonded pad from a backing plate by utilizing a T-shaped removal bar which has a tip equipped with fastening means for fastening to the pad.

It is stiff another object of the present invention to provide a method for removing an adhesive bonded pad from a backing plate by using a T-shaped removal bar in a rotational motion of the bar to break the adhesive bond between the pad and a table to which the pad is bonded.

It is yet another object of the present invention to provide a method for removing an adhesive bonded pad from a backing plate by utilizing a T-shaped removal bar and shear force to remove the pad.

It is still another further object of the present invention to provide an apparatus for removing an adhesive bonded pad from a backing plate which is constructed in a T-shaped bar equipped with a fastening device at the tip of the T for fastening to a pad.

It is yet another further object of the present invention to provide an apparatus for removing an adhesive bonded pad from a backing plate which is constructed of a circular cross-sectional tubing for easier rotation and removal of the pad by shear force.

SUMMARY OF THE INVENTION

In accordance with the present invention, an apparatus and a method for removing an adhesive bonded pad from a backing plate are provided.

In the preferred embodiment, an apparatus for removing adhesive bonded pad from a backing plate is provided which includes an elongated tube that has a free end and an opposite end integrally joined with a handle forming a "T", the free end is equipped with a fastening means adapted for fastening to an edge portion of a pad, the T-shaped handle is adapted for operation by human hands for applying a shear force on the pad onto which the free end is fastened when the handle is rotated for separating the pad from a backing plate the pad is bonded to.

In the apparatus, the elongated rod has a circular cross-section to facilitate a rotational motion of the rod when the T-shaped handle is turned. The fastening means may include screws and wing nuts equipped with female threads for threadingly engaging the screws. The fastening means may further include a rigid plate for engaging the pad and the wing nuts such that the pad may be securely fastened between the rigid plate and the free end of the elongated rod.

In the apparatus, the screws may be adapted for engaging at least one aperture provided in an edge portion of the pad. The screws may be adapted for engaging two apertures in an edge portion of the pad. The pad may be a polishing pad, or a polishing pad used in a chemical mechanical polishing apparatus. The polishing pad may be adhesively bonded to a steel backing plate. The fastening means in the free end may further include a flattened tube section which has at least one mounting screw integrally joined to the flattened tube section.

The present invention is further directed to a method for removing an adhesively bonded pad from a backing plate which can be carried out by the operating steps of first providing an elongated rod which has a free end and an opposite end integrally joined with a handle forming a "T", the free end is equipped with a fastening means adapted for fastening to an edge portion of a pad, the handle is adapted for turning by human hands and for applying a shear force on the pad onto which the free end is fastened for separating the pad from the backing plate which the pad is bonded to, attaching the edge portion of the pad to the fastening means, and rotating the handle toward a center of the pad such that the adhesively bonded pad separates from the backing plate.

In the method for removing an adhesively bonded pad from a backing plate, the adhesively bonded pad may be a polishing pad which is used in a chemical mechanical polishing apparatus. The method may further include the steps of forming at least one aperture in an edge portion of the pad, then attaching the edge portion of the pad to the fastening means through the at least one aperture. The method may further include the step of forming two apertures in an edge portion of the pad.

The method may further include the step of attaching the edge portion of the pad to the free end of the elongated rod by clamping means. The method may further include the step of providing a flattened tube section in the free end with at least one mounting screw integrally joined thereto. The method may further include the steps of providing a flattened section in the free end of the elongated rod, and then joining integrally two mounting screws to the flattened end portion. The method may still further include the step of rotating the handle and using shear force for breaking the adhesive bond between the pad and the backing plate. The method may further include the steps of forming a flattened end portion in the free end of the elongated rod, joining integrally at least one mounting screw to the flattened end portion, attaching at least one aperture formed in an edge portion of the pad to the at least one mounting screw, and then fastening the pad to the flattened end portion by at least one nut. The method may still further include the step of providing a rigid plate for engaging the pad and the flattened end portion by using the at least one screw and the at least one nut.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses an apparatus for removing an adhesive bonded pad from a backing plate, for instance, for removing a chemical mechanical polishing (CMP) pad from a rotating table. The present invention further discloses a method for removing an adhesive bonded pad from a backing plate by using shear force in a rotational motion. The present invention apparatus and method allow the removal of a CMP polishing pad, or any other pad that is strongly bonded to a backing substrate to be removed with a minimal effort. The motion of a machine operator for removing the pad is changed from the conventional method of using tensile force applied on a pad by a pair of pliers to the present invention method of using shear force applied on the pad by using the present invention apparatus. Any personal injury risk to the machine operator during the removal procedure, i.e., a slip of the pair of pliers from the polishing pad, is thus eliminated.

Since the polishing pad in a CMP apparatus is removed frequently, i.e., at an interval between about 12 hours and about 18 hours, the present invention novel apparatus can be advantageously used to accomplish the task at a minimal time and labor.

The apparatus may be provided with a flattened section at the tip of the elongated rod such that a large surface area may be used for attaching the pad. The flattened area may be provided with bolts and using nuts for engaging the bolts such that an edge portion of a pad may be securely fastened therein. While the bolt/wing nut arrangement provides a convenient means for attachment, any other mechanical attachment method such as clamps may also be used in the present invention novel apparatus.

The present invention novel apparatus may further utilize a rigid plate for placing on top of the flattened tube section to provide enforcement in fastening the pad to the removal tool. The rigid plate may be in the shape of a rectangular plate so that clamping force on the pad can be uniformly distributed and applied onto the pad surface. Once the pad is fastened in the edge portion by the mounting plate/wing nut arrangement or by any other clamping means, a machine operator turns the handle to slowly peel off the pad from the backing substrate. During the separation process, shear force is used to break the adhesive bond formed between the back of the polishing pad and the top surface of the backing substrate. It should be noted that the peel-back action is performed by the machine operator in sideways such that any slippage of the tool from the operator does not pose a personal injury threat to the operator. This is contrary to the conventional method in which a pair of pliers is used by the operator to grab hold of an edge of the pad and to pull in a direction toward the operator himself A slip of the pliers presents a serious injury threat to the operator.

Figure 2A:
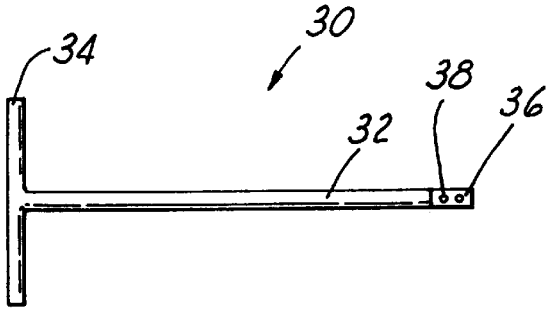
FIG. 2A is a plane view of the present invention apparatus.
Figure 2C:
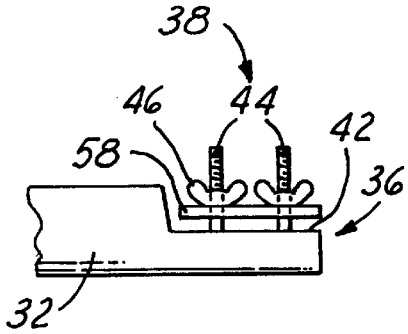
FIG. 2C is a partial, cross-sectional view of the flattened end portion of the present invention apparatus.
Figure 2B:
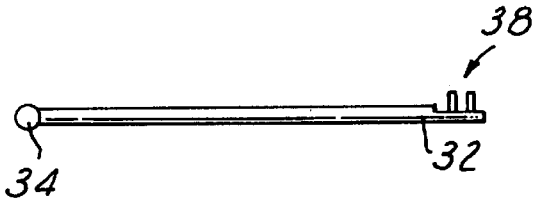
FIG. 2B is a side view of the present invention apparatus.

Referring now to FIG. 2A wherein a present invention pad removal tool 30 is shown. The pad removal tool 30 is constructed by two tubular sections 32 and 34 arranged in a T-shape. A side view of the pad removal tool 30 is shown in FIG. 2B, while a partial, enlarged cross-sectional view of the end section of the tube 32 is shown in FIG. 2C. As shown in FIG. 2A, the tubular sections 32 and 34 may be suitably constructed by stainless steel hollow tubes of approximately one inch diameter. Any other suitable dimensions of the tube may also be utilized. Any other suitable material as long as it has the necessary rigidity may also be utilized in constructing the tubes 32 and 34. The hollow tubes are utilized for their light weight. However, there is no reason that solid rods may not be used. The horizontal tube section 32 is provided with an end portion 36 equipped with fastening means 38. A detailed, enlarged view of the end portion 36 and the fastening means 38 is shown in FIG. 2C. It should be noted that the specific embodiment shown in FIG. 2C is only one of many possible variations for practicing the present invention novel method.

As shown in FIG. 2C, the end portion 36 is provided with a flattened surface 42 on which at least one bolt 44 may be provided. The fastening means 38 further includes at least one nut 46, preferably of the wing nut type, for mechanically engaging the bolt 44.

Figure 2D:
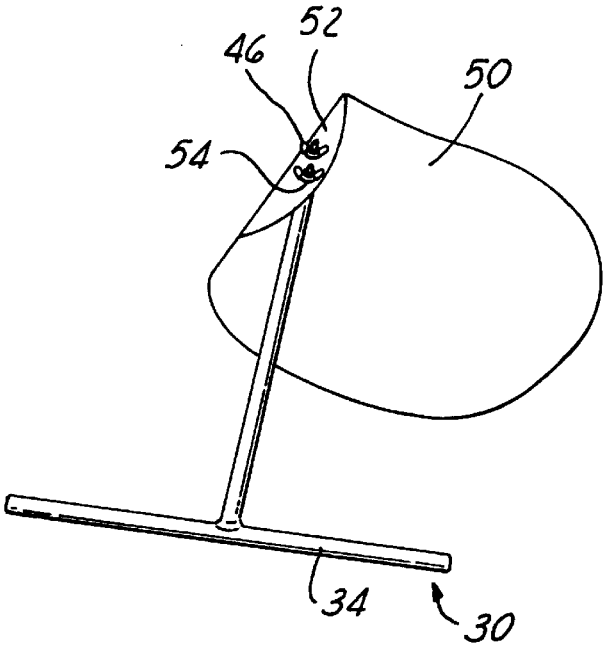
FIG. 2D is a perspective view of the present invention apparatus when attached to a pad for removal.

To utilize the present invention fastening means on the end portion of the pad removal tool 30, the edge portion 52 of a pad 50, as shown in FIG. 2D, is provided with at least one aperture 54. The edge portion 52 of the pad 50 is then attached to the end portion 36 of the pad removal tool 30 by first penetrating the bolts 44 through the apertures 54 and then attaching the wing nuts 46. To further improve the fastening efficiency, a rigid plate 58 such as one fabricated of steel, may be used between the wing nuts 46 and the flattened tube surface 42. The rigid plate 58 assists in the distribution of force imposed by the wing nuts 46 to eliminate any potential of tearing or cracking of the pad 50.

Figure 1B:
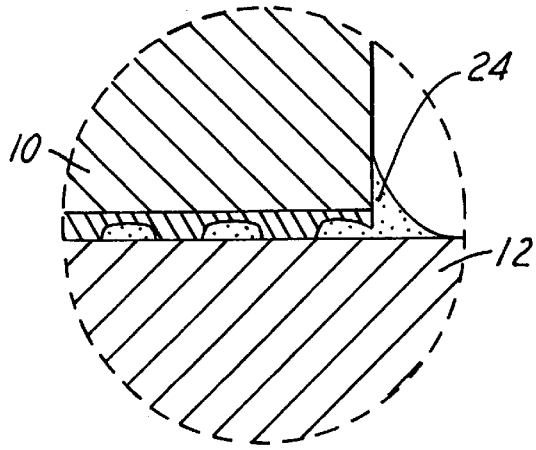
(PRIOR ART) FIG. 1B
FIG. 1B is a partial, enlarged cross-sectional view taken from FIG. 1A showing the interaction of slurry between the wafer and the polishing pad.
Figure 1A:
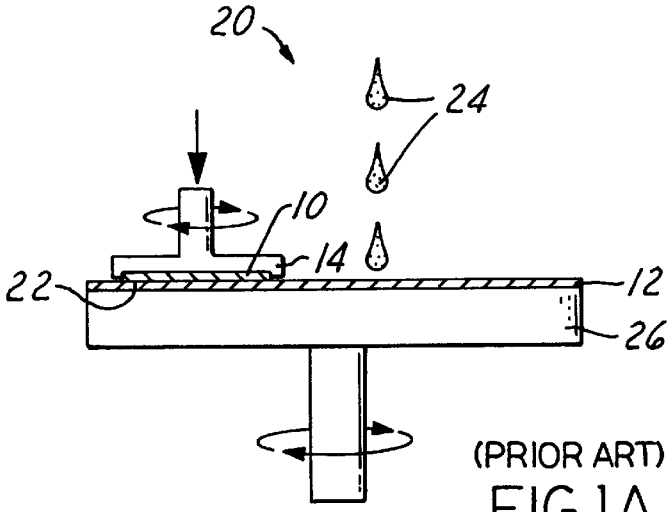
(PRIOR ART) FIG. 1A
FIG. 1A is a cross-sectional view of a conventional chemical mechanical polishing apparatus.
Figure 1C:
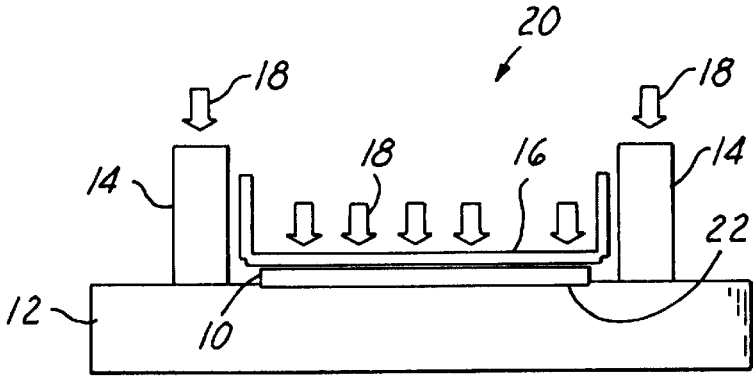
(PRIOR ART) FIG. 1C
FIG. 1C is a cross-sectional view illustrating an improved polishing head utilizing a membrane pressuring device.

To operate the present invention novel pad removal tool 30, as shown in FIG. 2D, the end portion 36 of the removal tool 30 is first attached to the edge portion 52 of the polishing pad 50. After the wing nuts 46 are tightened on the rigid plate 58 and the bolts 44, the removal tool 30 may be operated by an operator by holding the handle portion 34 and rotating toward the center of the pad. The polishing pad 50 can therefore be peeled off the surface of the substrate plate (not shown in FIG. 2D) by a shear force applied on the adhesive joint between the polishing pad 50 and the rotating table 26 (FIG. 1A). The benefits achieved by the present invention novel pad removal tool is evident by an inspection of FIG. 2D. When an operator stands next to a chemical mechanical polishing tool, the direction of the pad removal is not toward the operator, but instead in a path in front of the operator. Any slippage of the tool 30 from the hands of the operator would not cause personal injury to the operator.

The present invention novel method and apparatus have therefore been amply demonstrated in the above descriptions and in the appended drawings of FIGS. 2A–2D. While the present invention has been described in an illustrative manner, it should be understood that the terminology used is intended to be in a nature of words of description rather than of limitation.

Furthermore, while the present invention has been described in terms of a preferred embodiment and an alternate embodiment, it is to be appreciated that those skilled in the art will readily apply these teachings to other possible variations of the inventions.

The embodiment of the invention in which an exclusive property or privilege is claimed are defined as follows:

1. An apparatus for removing an adhesive pad from a backing plate comprising:

an elongated rod having a free end and an opposite end integrally joined with a handle forming a "T", said free end being equipped with a fastening means adapted for fastening to an edge portion of a pad, said fastening means comprises bolts and wing nuts equipped with female threads for threadingly engaging said bolts, and said handle being adapted for operation by hand and for applying a shear force on said pad onto which said free end is fastened when the handle is turned for separating the pad from a backing plate which the pad is adhesively bonded to.

2. An apparatus for removing an adhesive bonded pad from a backing plate according to claim 1, wherein said elongated rod having a circular cross-section to facilitate a rotational motion of the rod when said handle is rotated.

3. An apparatus for removing an adhesive bonded pad from a backing plate according to claim 1, wherein said fastening means further comprises a rigid plate for engaging said pad and said wing nuts such that said pad may be securely fastened between said rigid plate and said free end of the elongated rod.

4. An apparatus for removing an adhesive bonded pad from a backing plate according to claim 1, wherein said bolts are adapted for engaging at least one aperture provided in an edge portion of the pad.

5. An apparatus for removing an adhesive bonded pad from a backing plate according to claim 1, wherein said bolts are adapted for engaging two apertures in an edge portion of said pad.

6. An apparatus for removing an adhesive bonded pad from a backing plate according to claim 1, wherein said pad is a polishing pad.

7. An apparatus for removing an adhesive bonded pad from a backing plate according to claim 1, wherein said paid is a chemical mechanical polishing pad.

8. An apparatus for removing an adhesive bonded pad from a backing plate according to claim 1, wherein said pad is a polishing pad used in a chemical mechanical polisher and is adhesively bonded to a steel plate.

9. An apparatus for removing an adhesive bonded pad from a backing plate according to claim 1, wherein said fastening means in said free end further comprises a flattened tube section having at least one mounting bolt integrally joined to the flattened tube section.

10. A method for removing an adhesively bonded pad from a backing plate comprising the steps of:

providing an elongated rod having a free end and an opposite end integrally joined with a handle forming a "T", said free end being equipped with a flattened tube section with at least one mounting bolt integrally formed thereon for fastening to an edge portion of a pad, said handle being adapted for operation by hand and for applying a shear force on said pad onto which said free end is fastened when the handle is turned for separating the pad from a backing plate which the pad is adhesively bonded to, attaching said edge portion of the pad to said fastening means, and rotating said handle toward a center of said pad such that said adhesive bonded pad separates from said backing plate.

11. A method for removing an adhesively bonded pad from a backing plate according to claim 10, wherein said adhesively bonded pad is a polishing pad used in a chemical mechanical polishing apparatus.

12. A method for removing an adhesively bonded pad from a backing plate according to claim 10 further comprising the steps of:

forming at least one aperture in an edge portion of said pad, and attaching said edge portion of the pad to said fastening means through said at least one aperture.

13. A method for removing an adhesively bonded pad from a backing plate according to claim 12 further comprising the step of forming two apertures in an edge portion of said pad.

14. A method for removing an adhesively bonded pad from a backing plate according to claim 10 further comprising the step of attaching said edge portion of the pad to the free end of said elongated rod by clamping means.

15. A method for removing an adhesively bonded pad from a backing plate according to claim 10 further comprising the steps of:

providing a flatten end section in said free end of the elongated rod, and joining integrally two mounting bolts to said flattened end portion.

16. A method for removing an adhesively bonded pad from a backing plate according to claim 11 further comprising the step of rotating said handle and utilizing shear force for breaking the adhesive bond between said pad and said backing plate.

17. A method for removing an adhesively bonded pad from a backing plate according to claim 10 further comprising the steps of:

forming a flattened end portion in said free end of the elongated rod, joining integrally at least one mounting screw to said flattened end portion, attaching at least one aperture formed in an edge portion of said pad to said at least one mounting bolt, and fastening said pad to said flattened end portion by at least one nut.

18. A method for removing an adhesively bonded pad from a backing plate according to claim 17 further comprising the step of providing a rigid plate for engaging said pad and said flattened end portion by said at least one bolt and said at least one nut.

* * * * *